US005238119A

United States Patent [19]

Simon et al.

[11] Patent Number: 5,238,119

[45] Date of Patent: Aug. 24, 1993

[54] BENEFICIATION OF CALCIUM BORATE MINERALS

[75] Inventors: John M. Simon, Chessington; Christopher H. Barwise, Hampshire, both of England

[73] Assignee: U.S. Borax Inc., Valencia, Calif.

[21] Appl. No.: 907,912

[22] Filed: Jul. 2, 1992

Related U.S. Application Data

[63] Continuation-in-part of Ser. No. 525,830, May 18, 1990, abandoned, and a continuation-in-part of Ser. No. 516,188, Apr. 30, 1990, abandoned.

[30] Foreign Application Priority Data

Jul. 29, 1989 [GB] United Kingdom ..... 8917426
Mar. 30, 1990 [GB] United Kingdom ..... 9007229

[51] Int. Cl.[5] ..... B03D 1/012; B03D 1/02
[52] U.S. Cl. ..... 209/166; 252/61
[58] Field of Search ..... 209/166, 167; 252/61

[56] References Cited

U.S. PATENT DOCUMENTS

| | | | |
|---|---|---|---|
| 2,184,558 | 12/1939 | Molozemoff | 209/166 |
| 2,317,413 | 4/1943 | Shelton | 209/166 |
| 3,635,338 | 1/1972 | Chemtob | 209/166 |
| 3,768,738 | 10/1973 | Sawyer | 209/166 |
| 3,917,801 | 11/1975 | Wilson | 209/167 |
| 4,146,473 | 3/1979 | Edelmann et al. | 210/52 |
| 4,153,549 | 5/1979 | Wang et al. | 210/54 |
| 4,158,623 | 6/1979 | Wang | 209/166 |
| 4,199,065 | 4/1980 | Wang | 209/166 |
| 4,210,531 | 7/1980 | Wang et al. | 210/51 |
| 4,510,048 | 4/1985 | Mai | 209/166 |
| 4,510,049 | 4/1985 | Mai | 209/166 |
| 5,122,290 | 6/1992 | Barwise | 209/166 |

OTHER PUBLICATIONS

Mona Industries, MONAWET Surfactants, Tech. Bulletin 212H, Apr. 1985.

American Cyanamid Co., AEROSOL Performance Surfactants, PRC-46E, 884604 3K, Apr. 1988.

*Primary Examiner*—Thomas M. Lithgow
*Attorney, Agent, or Firm*—James R. Thornton

[57] ABSTRACT

Particles of a calcium borate mineral, such as colemanite or ulexite, are recovered from an ore by a froth flotation process using a dialkyl sulfosuccinate as collector. Suitable dialkyl sulfosuccinates include sodium or ammonium dinonyl sulfosuccinate, sodium or ammonium di-isodecyl sulfosuccinate, and sodium or ammonium dialauryl sulfosuccinate. The dialkyl sulfosuccinates may be used as aqueous solutions or as solutions in solvents consisting of water and methylated spirit, a dihydric alcohol such as ethylene glycol or hexylene glycol or a monohydric alcohol containing more than 5 carbons. Preferred collectors are the dinonyl sulfosuccinate salts, such as a compound of the formula,

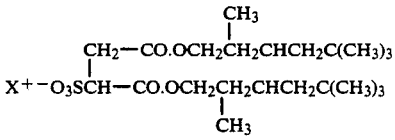

wherein $X^+$ is a counterion.

21 Claims, No Drawings

BENEFICIATION OF CALCIUM BORATE MINERALS

This is a continuation-in-part of copending applications Ser. No. 07/525,830 (now abandoned) filed May 18, 1990 by John M. Simon and Ser. No. 07/516,188 (now abandoned) filed Apr. 30, 1990 by Christopher H. Barwise.

The present invention relates to the beneficiation of calcium borate ores such as colemanite and ulexite, by froth flotation.

The mineral colemanite is a hydrated calcium borate having a formula which may be represented as $CA_2B_6O_{11}.5H_2O$. It can occur in massive deposits or in association with other calcium-containing minerals, such as calcite, gypsum and quartz and clays. Low grade colemanite deposits contain, for example, only 15 to 20 weight percent $B_2O_3$ in association with significant quantities of montmorillonite clay, calcite, gypsum and quartz. Such low grade deposits contain insufficient colemanite, expressed in $B_2O_3$, to be satisfactory for use in the preparation of, for example, textile fiberglass. To be acceptable for such use a low grade ore needs to be upgraded, or beneficiated, so as to contain 40 weight % or more, preferably at least 42 weight % $B_2O_3$. Ulexite is a hydrated sodium calcium borate having a formula which may be represented as $Na_2Ca_2B_{10}O_{18}.16H_2O$.

Froth flotation is a well known technique for use in the beneficiation of minerals. In froth flotation finely ground mineral particles are separated from associated gangue, a process which relies upon a selective affinity of air bubbles for the surface of the particles. An aqueous slurry or pulp of the mineral and associated gangue is aerated, mineral particles having a specific affinity for air bubbles then rise to the surface and are separated from other mineral particles wetted by water. In order to provide mineral particles with an affinity for air bubbles there are used flotation collectors which are adsorbed on a mineral by chemical or physical forces, including electrostatic attraction between an ionic collector and a mineral of opposite charge.

It is known to employ froth flotation in the beneficiation of calcium-containing minerals such as fluorite ($CaF_2$). However, it is generally considered to be difficult to separate one calcium-containing mineral from another calcium-containing mineral since a flotation collector, particularly an ionic collector, which provides the necessary affinity to the one mineral will provide it also to the other. In other words most ionic collectors lack specificity towards individual calcium-containing minerals.

Calcium borate minerals such as colemanite and ulexite are often recovered from their ores by froth flotation using as collector alkyl-aryl suphonates or, as described in U.S. Pat. No. 4,510,049, anionic petroleum sulphonates. However such collectors are not sufficiently selective for the calcium borate minerals and there is a tendency for unwanted minerals such as clay slimes, gypsum and other calcium minerals to be recovered in the froth flotation process as well.

It has now been found that calcium borate minerals can be recovered more selectively using a dialkyl sulphosuccinate as the collector in the froth flotation process.

According to this invention, there is provided a process for the recovery of a calcium borate mineral from an ore comprising adding to an aqueous slurry of particles of the ore a collector comprising a dialkyl sulphosuccinate, and subjecting the calcium borate particles to flotation in a froth flotation cell.

It is essential that each molecule of dialkyl sulphosuccinate contains two alkyl hydrocarbon chains in order to achieve the desired selectivity for floating of the calcium borate mineral.

Each alkyl group may contain for example between 6 and 18 carbons atoms. Preferably each alkyl group contains 8 to 14 carbon atoms.

Although the principal function of the dialkyl sulphosuccinate is that of a collector, the dialkyl sulphosuccinate may also act as a frother. When long carbon chain dialkyl sulphosuccinates are used as the collector a frother may need to be used.

Suitable dialkyl sulfosuccinates include sodium or ammonium dinonyl sulphosuccinate, sodium or ammonium di-isodecyl sulphosuccinate and sodium or ammonium dilauryl sulphosuccinate.

Sodium or ammonium dialkyl sulfosuccinates are commercially available as water based pastes, containing up to about 50% by weight of the sulphosuccinate and these pastes can be further diluted with water for use in the process of the invention.

Sodium or ammonium dialkyl sulfosuccinates are also commercially available as solutions in water and industrial methylated spirit, for example solutions containing 60–70% by weight dialkyl sulphosuccinate, 5–15% by weight water and 15–25% by weight industrial methylated spirit. As the industrial methylated spirit reduces the viscosity of the solution if enables a higher concentration of dialkyl sulphosuccinate to be used.

The dialkyl sulfosuccinates may also be used in the process of the invention as solutions in solvents consisting of water and either a dihydric alcohol such as ethylene glycol or hexylene glycol, or a monohydric alcohol containing more than 5 carbon atoms.

Usually the collector composition will contain 50–80% by weight dialkyl sulphosuccinate, 2–30% by weight water and 10–40% by weight dihydric alcohol or monohydric alcohol containing more than 5 carbon atoms.

The quantity of the collector composition used in the process of the invention will usually be in the range 300–1500 g/tonne of feed ore, i.e. calcium borate minerals and unwanted minerals, to be subjected to froth flotation.

The collector composition and process of the invention enable a better separation to be made between the calcium borate minerals which are required in a concentrate and the waste minerals which are not wanted, compared with know collectors and processes.

The following examples will serve to illustrate the invention.

Three troth flotation tests were carried out on a colemanite ore from Turkey.

The ore contained approximately 74% by weight colemanite and had been scrubbed, deslimed to remove clay, and ground to pass a 250 micron screen. In each test prior to the addition of a collector, 447.5 g of ground ore containing 10.06% by weight moisture was decanted three times in a 2.2 liters Denver cell in order to remove the slimes created during grinding. The critical terminal velocity for decantation was calculated as 0.75 mm per second.

The ore particles were then washed into a 1.1 liter Denver cell with soft water, and the resulting pulp was made up to 22% by weight solids with soft water. The temperature of the pulp in each test was between 13.25° C. and 14.5° C.

In the first test the collector used was 1:2 by weight mixture of low molecular weight and medium molecular weight petroleum sulphonates similar to those specified in U.S. Pat. No. 4,510,049. In the second test the collector used was a composition consisting of 70% by weight ammonium dinonyl sulphosuccinate, 20% by weight hexylene glycol and 10% by weight water and in the third test the collector used was a composition consisting of 70% by weight of a 90:10 by weight mixture of sodium di-isodecyl sulphosuccinate and ammonium dinonyl sulphosuccinate, 20% by weight methylated spirit and 10% by weight water.

In test 1, 3.6 ml of a 10% by weight aqueous solution of the collector was used and in tests 2 and 3, 9.1 ml of a 5% by weight aqueous solution of the collector composition was used. The collectors were added to the ore pulp in the 1.1 liter Denver cell and the pulp was conditioned by means of agitation for 5 minutes. No separate frother was added. Flotation was commenced and a rougher froth was taken off for 4.5 minutes in tests 1 and 2 and for 5 minutes in test 3. The pulp remaining in the cell was discharged as a tailing product. The rougher froths were then returned to the same cell and cleaned for 3.5 minutes in tests 1 and 2 and for 4.75 minutes in test 3.

The results obtained are tabulated below:

| PRODUCT | WEIGHT (g) | WEIGHT (%) | ASSAY (WT %) BORIC OXIDE | ASSAY (WT %) COLEMANITE | DISTRIBUTION (WT %) |
|---|---|---|---|---|---|
| TEST 1 | | | | | |
| SLIMES | 113.5 | 28.3 | 31.8 | 62.5 | 24.0 |
| CONCENTRATE | 198.5 | 49.5 | 46.8 | 92.0 | 61.7 |
| CLEANER TAIL | 29.0 | 7.3 | 26.3 | 51.7 | 5.1 |
| TAILING | 59.8 | 14.9 | 23.2 | 45.6 | 9.2 |
| TOTAL | 400.8 | 100.0 | 37.5 | 73.9 | 100.0 |
| TEST 2 | | | | | |
| SLIMES | 117.5 | 29.2 | 31.8 | 62.5 | 24.7 |
| CONCENTRATE | 192.5 | 47.8 | 49.7 | 97.75 | 63.3 |
| CLEANER TAIL | 14.25 | 3.6 | 21.7 | 42.7 | 2.1 |
| TAILING | 78.25 | 19.4 | 19.1 | 37.6 | 9.9 |
| TOTAL | 402.5 | 100.0 | 37.5 | 73.9 | 100.0 |
| TEST 3 | | | | | |
| SLIMES | 114.0 | 28.6 | 32.1 | 63.1 | 24.3 |
| CONCENTRATE | 205.75 | 51.5 | 48.1 | 94.6 | 65.6 |
| CLEANER TAIL | 17.4 | 4.4 | 21.6 | 42.5 | 2.5 |
| TAILING | 62.0 | 15.5 | 18.6 | 36.6 | 7.6 |
| TOTAL | 399.15 | 100.0 | 37.8 | 74.4 | 100.0 |

In test 1 the total of concentrate and cleaner tail which corresponds to the original rougher froth contained 44.2% by weight boric oxide (87.0% by weight colemanite) at a recovery of 66.8%. In test 2 the total concentrate and cleaner tail contained 47.7% by weight boric oxide (93.9% by weight colemanite) at a recovery of 65.4%. In test 3 the total of concentrate and cleaner tail contained 40.0% by weight boric oxide (90.6% by weight concentrate) at a recovery of 68.1%.

Although the dialkyl sulfosuccinates are not as powerful as the petroleum sulphonates as collectors and they need to be used in greater amounts, they are much more selective, and thus give better grade concentrates and higher recoveries of colemanite. The collector composition used in test 2 gave 5.75% by weight more colemanite in the concentrate with 1.6% higher recovery than the petroleum sulphonates in test 1. Similarly in test 3 the collector composition gave 2.6% by weight more colemanite in the concentrate and 4.9% higher recovery than the petroleum sulphonates in test 1.

The results also show that the weight and boron distribution in the cleaner tailing of test 1 were greater due to the poor selectivity of the petroleum sulphonates. Such inferior selectivity will often cause build-up of recirculating material in continuous froth flotation processes.

According to a preferred embodiment of this invention, it has been found that a particular group of dialkyl sulfosuccinate collectors is specific towards colemanite and can be used in the separation by froth flotation of colemanite from other calcium-containing minerals. Thus the invention also provides the use as an anionic flotation collector of dinonyl sulfosuccinate salts in the beneficiation by froth flotation of a colemanite ore containing colemanite in association with at least one other calcium-containing mineral. The branched chain nonyl compounds are preferred, especially the compound of the formula

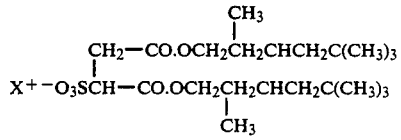

wherein $X^+$ is a counterion.

The preferred anion flotation collector is a bis (3,5,5-trimethylhexyl) sulfosuccinate salt and such salts are known. The active moiety is of course the anion and the counterion $X^+$ is generally relatively unimportant. To provide the salt with the desired water solubility the counterion $X^+$ is preferably an alkali metal, ammonium or ½ alkaline earth metal cation, in particular sodium, potassium or ammonium. (Valence considerations obviously arise so that the counterion $X^+$ may more accurately be represented as 1/n of a cation of formula $Y^{n+}$, where n is the valence of cation Y.)

The colemanite ores will generally be low grade ores containing as little colemanite as 15 to 20 weight percent expressed as $B_2O_3$, usually in association with such calcium-containing minerals as calcite, gypsum and quartz as well as clays such as montmorillonite. Analyses of such low grade ores will be found in the Examples which follow later. The colemanite usually occurs in such ores as coarsely crystalline mineralization. The colemanite can be intimately associated with sulfide minerals such as realgar (monoclinic arsenic monosulfide) or orpiment (monoclinic arsenic trisulfide). In this case it is preferred to subject the ore to a primary froth flotation to remove realgar and/or orpiment, before beneficiating the colemanite ore using the anionic collector.

Before the colemanite ore is subjected to any froth flotation it will usually subjected to appropriate preliminary treatments such as desliming and grinding, carried out in either order. Grinding carried out in order to reduce oversize material to a particle size suitable for forth flotation, say a particle size of −250 μm. The ore may be batch ground in a mill, wet screened at 250 μm, oversize returned to the mill for regrinding and the operation repeated until all solids pass through the screen. When desliming precedes grinding, a single grinding may be sufficient. Desliming can be carried out in conventional manner, as for example by decanting, screening or hydrocycloning. The use of a hydrocyclone is satisfactory when desliming a ground ore.

Clays present in a colemanite ore must be removed before flotation since their presence has a detrimental effect upon grades and recoveries. They may most readily be removed by the attrition scrubbing of ore/-water slurries. This breaks up clay aggregates and removes clay adhering to other materials.

Desliming after grinding can be difficult and may result in a loss of fine colemanite in the slimes fraction and incomplete desliming. A preferred sequence involves therefore attrition scrubbing, desliming, grinding, optional realgar and/or orpiment flotation and colemanite flotation. The colemanite flotation can be separated into a rougher flotation and a cleaner flotation to provide the desired colemanite concentrate.

When realgar and/or orpiment flotation is carried out, suitable collectors include kerosene, potassium amyl xanthate, mercaptobenzothiazole and butyl xanthogen ethyl formate. Additional reagents such as modifiers and frothers (such as methyl isobutyl carbinol) can be employed if necessary. Reagent conditioning can be carried out before the flotation if desired.

The froth flotation of a colemanite ore is generally carried out using the anionic collector formulated with a solvent base and water. The solvent base should be chosen to provide the desired frothing properties and collection power. Suitable solvent bases include alcohols or glycols such as hexylene glycol. In the examples which follow, tests were carried out on two samples of colemanite ores. The mineral compositions of these ore samples and chemical analyses of the ores are given in Tables 1 and 2 respectively.

TABLE 1

| CALCULATED MINERAL COMPOSITION OF COLEMANITE ORE SAMPLES | | |
|---|---|---|
| | SAMPLE 1 WEIGHT % | SAMPLE 2 WEIGHT % |
| COLEMANITE | 28 | 39 |
| HOWLITE | 2 | <1 |
| CALCITE | 14 | 13 |
| GYPSUM | 14 | 3 |
| ANHYDRITE | 1 | <1 |
| CELESTITE | 3 | 3 |
| QUARTZ | 9 | 10 |
| CLAYS | 29 | 31 |

TABLE 1-continued

| CALCULATED MINERAL COMPOSITION OF COLEMANITE ORE SAMPLES | | |
|---|---|---|
| | SAMPLE 1 WEIGHT % | SAMPLE 2 WEIGHT % |
| REALGAR | Tr | Tr |

TABLE 2

| CHEMICAL ANALYSIS OF COLEMANITE OR SAMPLES | | |
|---|---|---|
| | SAMPLE 1 WEIGHT % | SAMPLE 2 WEIGHT % |
| $B_2O_3$ | 15.3 | 19.9 |
| Cao | 20.5 | 17.5 |
| $SiO_2$ | 22.1 | 22.9 |
| MgO | 4.2 | 4.16 |
| $Fe_2O_2$ | 1.6 | 1.38 |
| $Al_2O_3$ | 4.8 | 4.92 |
| SrO | 1.5 | 1.78 |
| As | 0.27 | 0.32 |
| $SO_3$ | 9.0 | 3.11 |
| $CO_2$ | 6.4 | 6.1 |

It will be seen that sample 1 in particular contains a high proportion of gypsum. Gypsum tends to dissolve in process water used for desliming and flotation so that up to 20% weight loss can be observed. In the tests reported below, this was overcome by using water which has been saturated with a mixture of ground ore and calcium sulphate to reduce the loss of gypsum to less than 3%.

Ore was ground in a stainless steel laboratory rodmill at 50% w/w solids. The mill was 12 inches (30 cm) long and had an internal diameter of 5.5 inches (14 cm). The mill was operated at 120 rpm with a total rod charge of 9.5 kg, each rod being of stainless steel 10 inches long by 0.875 inches diameter (25 cm long by 2.2 cm diameter). Grinding was carried out to reduce the particle size to −250 μm. This could be achieved by grinding for an initial 3 minutes, wet screening at 250 μm, returning oversize to the mill for regrinding and repeating the operation until all the solids passed the screen. This product specification could be achieved using 3+3+0.5 minutes. A similar result could be achieved using 6+0.5 minutes and this was used for the flotation tests. For grinding a deslimed ore, a single 4 minute grind was adequate.

Attrition scrubbing was carried out on one kg batches in a Denver laboratory unit at 65% w/w/ solids. This comprised a flotation machine fitted with two 2.75 inch (7 cm) diameter three blade propellers with opposite pitch and rotated at 1500 rpm in a 1 liter perspex cell. For ore sample 1, 5 minutes scrubbing was found to be inadequate and excessive slimes were present in the flotation stage. Increasing the scrubbing time to 10 minutes gave more effective desliming.

Three desliming methods were employed in the tests, namely decanting, screening and hydrocycloning. Desliming of a scrubbed ore by diluting 1 kg of ore to 6 liters and allowing to stand for a short period before decanting was satisfactory because the colemanite was relatively coarse and settled rapidly, allowing easy separation from the slimes. $B_2O_3$ losses were typically 10 to 15%. Decanting was less satisfactory with ground ore using a similar decanting technique. Thus, the slimes tended to flocculate and settle if left more than a few minutes. The flocculated slimes also hindered settling of the sands. The method was not reproduceable, gave incomplete desliming and caused high losses of fine colemanite (up to one third of the borate).

Ground ore could satisfactorily be deslimed at 10 μm using a 30 mm diameter hydrocyclone. Milled ore was diluted to 6 liters and fed to the cyclone under pressure, collecting underflow and overflow products. The underflow (sands was reslurried and deslimed a second time. The net result, in terms of slimes rejection and $B_2O_3$ losses, was similar to that when using scrubbing and desliming.

Flotations were carried out using a Denver 12 machine in a 2.5 liter cell for realgar flotation and colemanite rougher flotation and a 5 liter cell for colemanite cleaner flotation. For realgar flotation, reagent conditioning was carried out in the flotation cell at 27 weight % solids. For colemanite flotation, ore was conditioned at 50 weight % solids using the attrition cell and a single propellor to give adequate mixing. The conditioned material was then transferred to the flotation cell and diluted for flotation. Realgar flotation was conducted at a natural pH 8.5.

TABLE 3

| | |
|---|---|
| 1. Realgar Flotation: Two stages (2.5L cell). | |
| (1) Kerosene | 0.15 L/t |
| MIBC | 0.10 l/T |
| Solids content | 27% w/w |
| Condition | 2 minutes |
| Float | 3–5 minutes |
| (2) Kerosene | 0.075 L/t |
| MIBC | — |
| Condition | 2 minutes |
| Float | 3–5 minutes |
| 2. Thicken tails to 60% w/w solids (filter if necessary). | |
| 3. Colemanite flotation. | |
| 3.1 Rougher | |
| Reagent dose: | Vary |
| Conditioning % solids: | 50 |
| Conditioning time: | 27% w/w |
| Cell volume: | 2.5L |
| 3.2 Cleaner (on rougher concentrate) | |
| % solids: | 5% w/w |
| Cell colume: | 5L |
| Conditioning: | None |

TABLE 4

| TEST NO | ROUTE | DESLIME | COLLECTOR | kg/t | CONCENTRATE % $B_2O_3$ | CONCENTRATE ppm As | % RECOVERY FLOTATION | % RECOVERY OVERALL | $B_2O_3$ TO SLIMES % |
|---|---|---|---|---|---|---|---|---|---|
| 1 | Grind/deslime | Decant | (I) | 1.0 | 43.1 | 1700 | 45.8 | 34.7 | 24.2 |
| 2 | " | " | (I) | 0.5 | 41.0 | 980 | 88.8 | 59.5 | 33.0 |
| CONTROL 1 | " | " | A801/825 | 0.75/0.25 | 37.0 | 1250 | 87.0 | 58.7 | 32.5 |
| 3 | " | " | (I) | 0.7/0.125 | 41.1 | 600 | 92.0 | 62.1 | 32.5 |
| 4 | Scrub/deslime | Screen 250 μm | (I) | 0.2/0.8 | 41.9 | 1170 | 45.7 | 39.2 | 14.3 |
| CONTROL 2 | " | " | A801/825 | 0.75/0.25 | 23.1 | 2400 | 27.7 | 22.3 | 19.4 |
| CONTROL 3 | Grand/deslime | Cyclone 10 μm | A801/825 | 0.25/0.75 | 34.2 | 1040 | 82.1 | 72.9 | 11.2 |
| 5 | " | " | (I) | 1.0 | 44.3 | 490 | 76.4 | 67.8 | 11.3 |
| 6 | Scrub/deslime | Decant | (I) | 0.75 | 40.7 | 970 | 76.1 | 63.0 | 14.8 |

NOTE (1)
CONTROL 3 AND TEST 5 DESLIME AFTER REALGAR FLOTATION, 10 μm

The colemanite flotations were carried out employing the ammonium salt of the anionic collector of formula (I). This was employed formulated with a hexylene glycol base and water. The performance of this anionic collector was compared with that of a mixture of petroleum sulfonates (Aero promoter 801 R and 825). Such promoters are commercially available and have been used in a number of different oxide flotation applications.

Test Nos. 1 to 6 and Controls 1 to 3

The flotation testing of ore sample 1 (see Tables 1 and 2) was carried out under the standard flotation conditions set out in Table 3, with the results summarized in Table 4. As can clearly be seen from Table 4, the use of an anionic collector of formula (I) yields concentrates containing in excess of 40 weight % $B_2O_3$, whereas the use of the petroleum sulfonate collectors A801/825 (controls 1 to 3) yields concentrates having significantly lower concentrations of $B_2O_3$.

Tests 7 to 19 and Control 4

Flotation tests were carried out on ore sample 2 (see Tables 1 and 2) with the results summarized in Table 5. Different realgar collectors were employed as follows:

a) Kerosene used with a frother, methylisobutyl carbonol (MIBC).

b) Potassium amyl xanthate (KAX) (Cyanamid Aero xanthate 350), used with a frother (Aero frother (AF) 65).

c) Mercaptobenzothiazole (Cyanamid Aero promoter (Ap) 412).

d) Butyl xanthogen ethyl formate (Minerec B), used with a frother (AF 65).

Each realgar flotation was conducted at pH 8.5 except when using mercaptobenzothiazole. KAX was also tested in combination with diesel oil.

As can be seen from the results summarized in Table 5, the use of the anionic collector (I) provides concentrates containing in excess of 42 weight % $B_2O_3$, whereas the use of petroleum sulphonate collectors did not.

TABLE 5

FLOTATION TESTING OF ORE SAMPLE 2

| TEST NO | GRINDING PRIMARY | GRINDING REGRIND | FLOTATION REAGENTS REALGAR | FLOTATION REAGENTS COLEMANTITE | CLEANING STAGES | FINAL CONC. % $B_2O_3$ | FINAL CONC. ppm As | OVERALL $B_2O_3$ RECOVERY % |
|---|---|---|---|---|---|---|---|---|
| CONTROL 4 | 75%-113 μm | NO | KEROSENE, MIBC | 801/825 (1:3) 1.5 kg/t | 1 | 38.9 | 660 | 73.9 |

TABLE 5-continued

FLOTATION TESTING OF ORE SAMPLE 2

| TEST NO | GRINDING PRIMARY | GRINDING REGRIND | FLOTATION REAGENTS REALGAR | FLOTATION REAGENTS COLEMANTITE | CLEANING STAGES | FINAL CONC. % $B_2O_3$ | FINAL CONC. ppm As | OVERALL $B_2O_3$ RECOVERY % |
|---|---|---|---|---|---|---|---|---|
| 7 | " | NO | " | (I) 1.24 kg/t | 1 | 43.7 | 510 | 72.6 |
| 8 | " | NO | " | (I) 1.5 kg/t | 1 | 44.4 | 430 | 75.3 |
| 9 | " | NO | " | (I) 1.25 kg/t | 1 | 43.3 | 410 | 82.2 |
| 10 | " | NO | " | (I) 1.25 kg/t | 1 | 43.3 | 390 | 80.8 |
| 11 | " | YES | " | (I) 1.5 kg/t | 2 | 47.3 | 270 | 51.2 |
| 12 | " | NO | KAX, AF 88, PINE OIL | (I) 1.5 kg/t | 2 | 47.0 | 250 | 76.6 |
| 13 | " | NO | AP 412, pH 7 | (I) 1.5 kg/t | 2 | 47.5 | 400 | 82.4 |
| 14 | " | YES | KAX, AF 65 | (I) 1.5 kg/t | 2 | 43.8 | 310 | 63.1 |
| 15 | 89%-113 μm | NO | KAX, AF 65 | (I) 1.5 kg/t | 2 | 46.9 | 270 | 76.1 |
| 16 | 89%-113 μm | NO | KAX, AF 65, DIESEL | (I) 1.5 kg/t | 2 | 46.8 | 310 | 65.8 |
| 17 | 93%-113 μm | NO | KAX, AF 65 | (I) 1.5 kg/t | 2 | 42.4 | 400 | 35.0 |
| 18 | 93%-113 μm | NO | KAX, AF 65 | (I) 1.5 kg/t | 2 | 42.6 | 330 | 78.0 |
| 19 | 93%-113 μm | NO | MINEREC B, AF 65 | (I) 1.5 kg/t | 2 | 41.7 | 300 | 74.8 |

NOTES:
(1) PROCESS ROUTE - SCRUB, DESLIME (2X DECANT), GRIND, FLOTATION
(2) TEST 10 - LOW ENERGY SCRUB
(3) SIZE ANALYSIS ON ROUGHER TAILINGS

What is claimed is:

1. In the beneficiation by froth flotation of a colemanite ore containing colemanite in association with at least one other calcium-containing mineral by subjecting finely divided particles of said ore to a froth flotation process in the presence of an ionic collector, the improvement which comprises the use of a di-nonyl sulfosuccinate salt as said ionic collector, thereby separating colemanite from said other calcium-containing mineral and collecting colemanite as a concentrate.

2. The process according to claim 1 in which said di-nonyl sulfosuccinate is a branched-chain nonyl.

3. The process according to claim 1 in which said di-nonyl sulfosuccinate is a compound of the formula

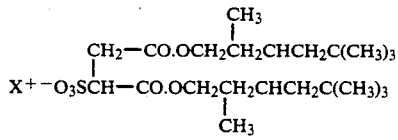

wherein X+ is a counterion.

4. The process according to claim 3 wherein X+ is an alkali metal, ammonium or ½ alkaline earth metal cation.

5. The process according to claim 1 wherein the other calcium-containing mineral is selected from the group consisting of calcite and gypsum.

6. The process according to claim 1 wherein prior to froth flotation the ore has been deslimed and ground, in either order.

7. The process according to claim 6 wherein after having been deslimed and ground, in either order, the ore is subjected to a preliminary froth flotation to remove realgar and optionally also orpiment.

8. The process according to claim 1 in which said dinonyl sulfosuccinate salt is ammonium bis(3,5,5-trimethylhexyl) sulfosuccinate.

9. A process for the recovery of calcium borate mineral particles from an ore, said process comprising the steps of:

adding to an aqueous slurry of particles of the ore a collector comprising a dialkyl sulfosuccinate which renders hydrophobic the particles of calcium borate mineral, and subjecting the ore containing said calcium borate particles to flotation in a froth flotation cell whereby the calcium borate particles float to the surface of the aqueous slurry and recovering said floated calcium borate particles.

10. A process according claim 9 wherein the dialkyl sulfosuccinate contains 6 to 18 carbon atoms in each alkyl group.

11. A process according claim 10 wherein the dialkyl sulfosuccinate contains 8 to 14 carbon atoms in each alkyl group.

12. A process according to claim 11 wherein the dialkyl sulfosuccinate is sodium dinonyl sulfosuccinate, ammonium dinonyl sulfosuccinate, sodium di-isodecyl sulfosuccinate, ammonium di-isodecyl sulfosuccinate, sodium dilauryl sulfosuccinate or ammonium dilauryl sulfosuccinate.

13. A process according to claim 9 wherein the dialkyl sulfosuccinate is added to the aqueous slurry of ore particles as an aqueous solution.

14. A process according to claim 9 wherein the dialkyl sulfosuccinate is added to the aqueous slurry of ore particles as a solution in water and methylated spirit.

15. A process according to claim 14 wherein the solution contains 60–70% by weight of dialkyl sulfosuccinate, 5–15% by weight water and 15–25% by weight methylated spirit.

16. A process according to claim 9 wherein the dialkyl sulfosuccinate is added to the aqueous slurry of ore particles as a solution in a dihydric alcohol or a monohydric alcohol containing more than 5 carbon atoms.

17. A process according to claim 16 wherein the dihydric alcohol is ethylene glycol or hexylene glycol.

18. A process according to claim 16 wherein the solution contains 50–80% by weight dialkyl sulfosuccinate, 2–30% by weight water and 10–40% by weight dihydric alcohol or monohydric alcohol containing more than 5 carbon atoms.

19. A process according to claim 9 wherein the dialkyl sulfosuccinate is added to the aqueous slurry of ore particles as a solution in a solvent in an amount of 300 g to 1500 g of solution per ton of ore particles.

20. A process according to claim 9 wherein said calcium borate is colemanite.

21. A process according to claim 9 wherein said calcium borate is ulexite.

* * * * *